US007899348B2

(12) United States Patent
Maruyama et al.

(10) Patent No.: US 7,899,348 B2
(45) Date of Patent: Mar. 1, 2011

(54) IMAGE FORMING APPARATUS WITH DEVELOPING BIAS CORRECTING PORTION THAT CHANGES A DEVELOPING DENSITY ADJUSTMENT PATTERN

(75) Inventors: Yoshihiko Maruyama, Osaka (JP); Keisuke Isoda, Osaka (JP)

(73) Assignee: Kyocera Mita Corporation (JP)

( * ) Notice: Subject to any disclaimer, the term of this patent is extended or adjusted under 35 U.S.C. 154(b) by 643 days.

(21) Appl. No.: 11/964,955

(22) Filed: Dec. 27, 2007

(65) Prior Publication Data

US 2008/0187339 A1 Aug. 7, 2008

(30) Foreign Application Priority Data

Dec. 28, 2006 (JP) ..... 2006-355259

(51) Int. Cl.
*G03G 15/00* (2006.01)
*G03G 15/08* (2006.01)

(52) U.S. Cl. ..... 399/48; 399/49; 399/55; 399/72

(58) Field of Classification Search ..... 399/48, 399/49, 55, 72
See application file for complete search history.

(56) References Cited

U.S. PATENT DOCUMENTS 6,686,943 B2 * 2/2004 Ishii et al. ..... 399/49
7,398,025 B2 * 7/2008 Campbell et al. ..... 399/49

FOREIGN PATENT DOCUMENTS

JP 62-233978 10/1987
JP 62-235685 10/1987
JP 9-187997 7/1997

* cited by examiner

*Primary Examiner* — William J Royer
(74) *Attorney, Agent, or Firm* — Gerald E. Hespos; Michael J. Porco

(57) ABSTRACT

A controller takes in a detection signal indicating the surface electrical potential of a photoconductive drum (7) from a surface electrical potential sensor (step #1), and determines whether the surface electrical potential is smaller than the predetermined threshold value (step #2). As a result, when the controller (6) determines that the surface electrical potential is equal to or greater than the predetermined threshold value (NO in step #2), it uses the low print rate density patch to execute the density adjustments in accordance with the toner density and the developing bias associated with the density patch (step #3). When the controller (6) determines that the surface electrical potential is smaller than the predetermined threshold value (NO in step #1), it uses a high print rate density patch to execute the density adjustments in accordance with the toner density and the developing bias associated with the density patch (step #4).

8 Claims, 6 Drawing Sheets

IMAGE FORMING APPARATUS WITH DEVELOPING BIAS CORRECTING PORTION THAT CHANGES A DEVELOPING DENSITY ADJUSTMENT PATTERN

BACKGROUND OF THE INVENTION

1. Field of the Invention

The present invention relates to an image forming apparatus such as a printer, a copying machine, and a complex machine.

2. Description of the Related Art

Conventionally, there have been widely known image forming apparatuses adopting an electrophotographic method for forming an image of a document on a recording sheet. According to the electrophotographic method, a charging device uniformly charges a surface of a photoconductive drum, and an exposure device forms an electrostatic latent image corresponding to an image of a read document on the surface of the photoconductive drum. Then, toners are supplied to a portion of the electrostatic latent image so as to develop the image as a toner image, and a transfer device transfers the toner image formed on the photoconductive drum to a recording sheet.

As examples of technologies made in aim of stably maintaining a favorable state of an image forming operation performed in this kind of image forming apparatus even if a temperature change and a temporal change in a characteristic of a photoconductive member occurs, Japanese Patent Unexamined Publication No. 562-233978 (patent document 1) and Japanese Patent Unexamined Publication No. 562-235685 (patent document 2) propose technologies of changing a γ-conversion information (gradation correction information) with use of electric potential data of the photoconductive member. Further, Japanese Patent Unexamined Publication No. H9-187997 (patent document 3) discloses a technology of changing gradation correction information in accordance with at least one state detected from among states of a surface electrical potential, a developing bias, a toner density, an image density, a temperature, and a humidity.

In an image forming apparatus adopting the electrophotographic method, a developing density adjustment pattern having a predetermined print rate is read, and then a feedback control of controlling a developing bias in accordance with a density of the read developing density adjustment pattern is executed, so that a half-tone gradation is controlled. However, changes in temperature and humidity characteristics of a photoconductive drum and changes in a charging ability of a charging device due to environmental changes sometimes cause a phenomenon that the surface electrical potential of the photoconductive drum lowers. In a case where such phenomenon does not occur, a relationship between the developing bias and the toner density show a linearity. However, when the surface electrical potential of the photoconductive drum lowers as described above, the linearity in the relationship between the developing bias and the toner density is lost especially in the low gradation pattern, so that it becomes difficult to utilize the linearity to set a desirable developing bias.

Executing the correction processing with use of the γ conversion processing as disclosed in the patent documents 1, 2 causes increase in a correction processing time.

SUMMARY OF THE INVENTION

The present invention was made to solve the above-described problem, and its object is to provide an image forming apparatus which is capable of executing an optimal density adjustment while suppressing increase in a correction processing time to be less than that of conventional technologies.

The present invention includes an image forming apparatus comprising: a developing section for developing an electrostatic latent image formed on an image bearing member with use of developer applied with a developing bias; a density detecting portion for detecting directly or indirectly a density of a developed image formed on the image bearing member; a surface electrical potential detecting portion for detecting directly or indirectly a surface electrical potential of the image bearing member; a developing bias correcting portion for developing a predetermined developing density adjustment pattern on the image bearing member and correcting the developing bias in accordance with the density of the developing density adjustment pattern detected by the density detecting portion; a developing density adjustment pattern storage portion for storing a plurality of developing density adjustment patterns having print rates different from one another. The developing bias correcting portion changes a developing density adjustment pattern, which is to be developed on the image bearing member, in accordance with a surface electrical potential detected by the surface electrical potential detecting portion.

According to this invention, the developing density adjustment pattern, which is to be developed on the image bearing member, is changed in accordance with the surface electrical potential detected directly or indirectly by the surface electrical potential detecting portion. Accordingly, as compared to the case of executing a correction processing with use of a γ conversion processing like the conventional technologies, increase in a correction processing time can be suppressed drastically than that of the conventional technologies.

These and other objects, features and advantages of the present invention will become apparent upon reading of the following detailed description along with the accompanied drawings.

DETAILED DESCRIPTION OF THE PREFERRED EMBODIMENTS

Figure 1:
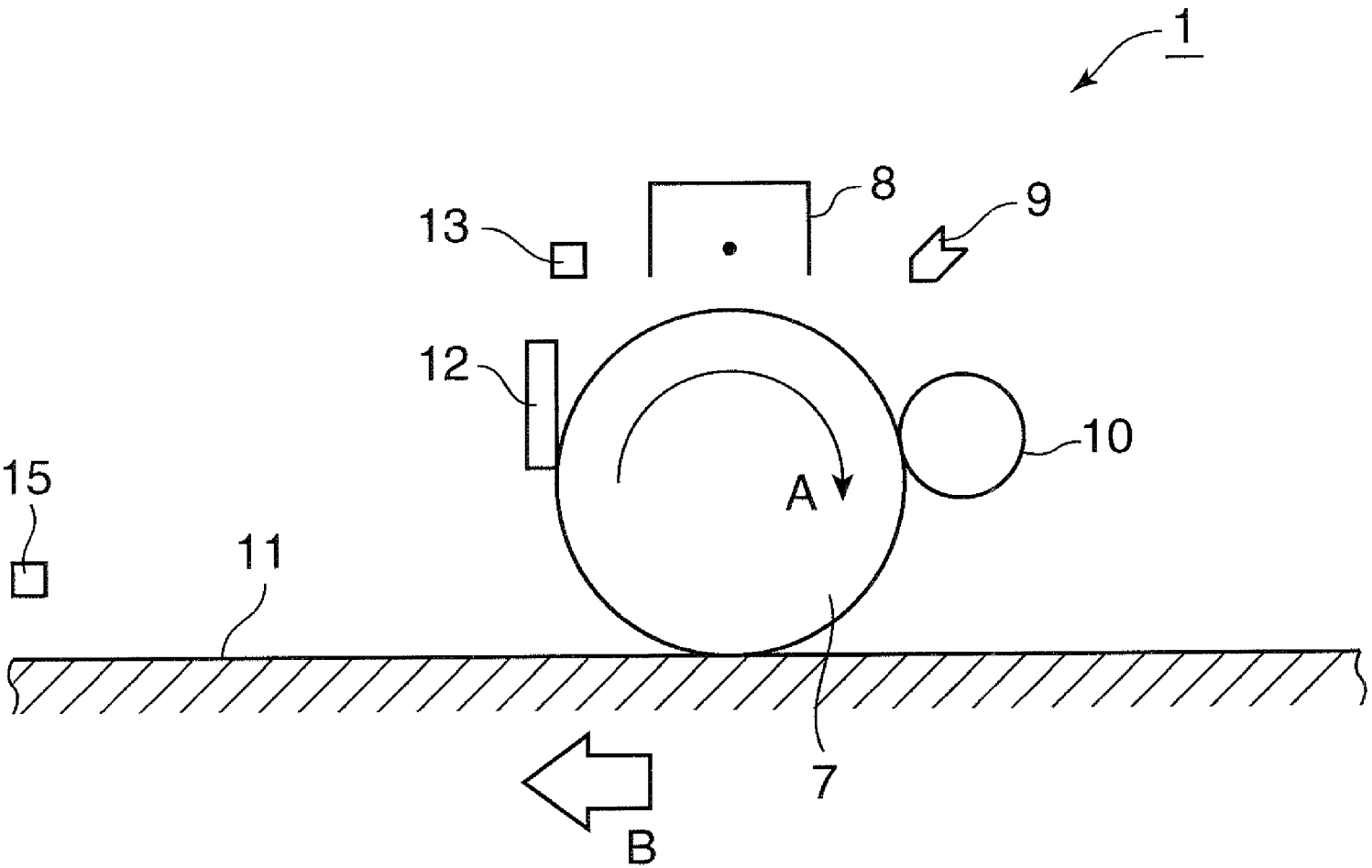
FIG. 1 is an internal configuration view showing an image forming section of a printer which is an example of an image forming apparatus in accordance with the present invention.
Figure 2:
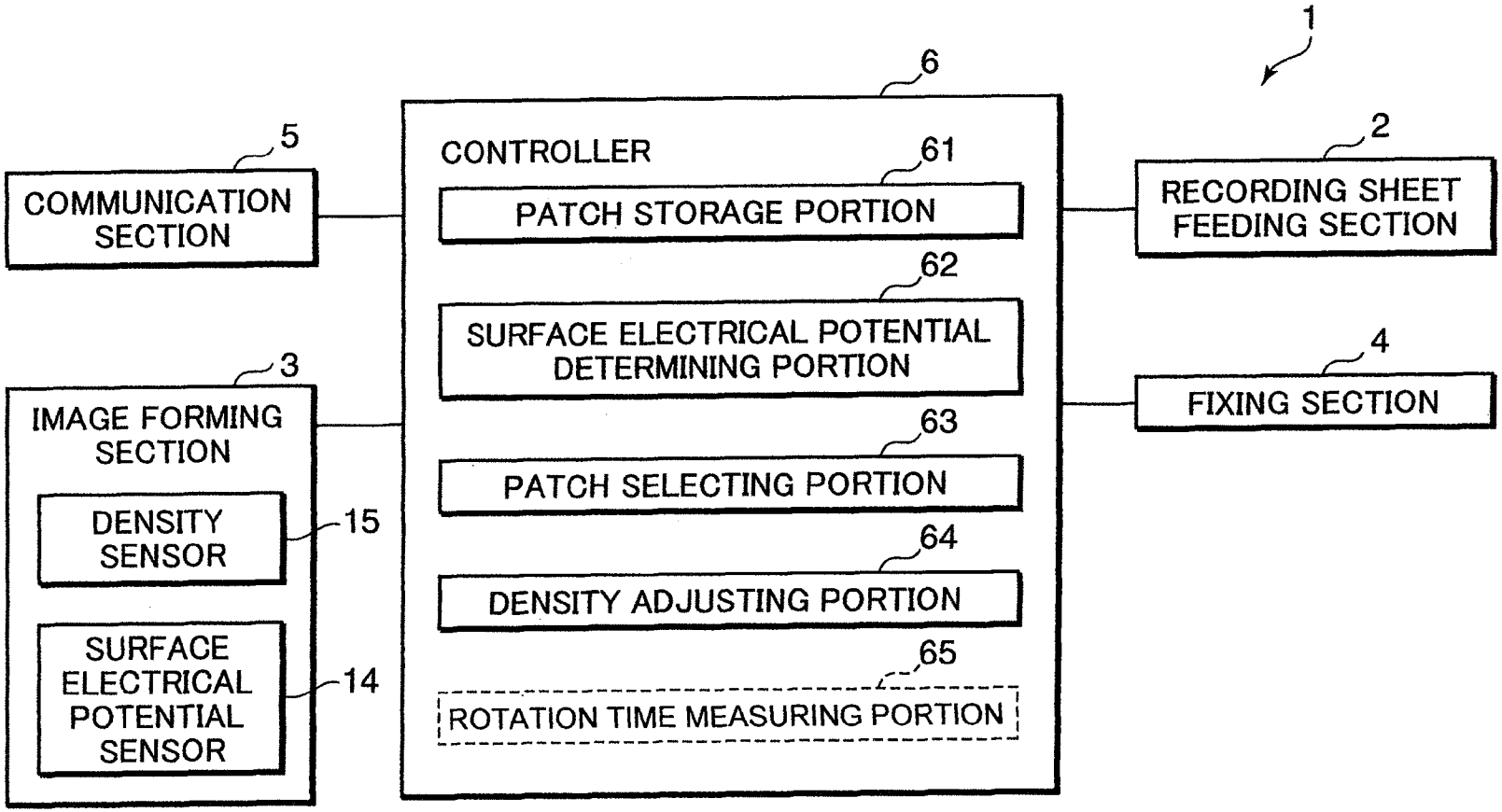
FIG. 2 is a block diagram showing an electrical configuration of the printer.

Hereinafter, an image forming apparatus in accordance with the present invention will be described. FIG. 1 is an internal configuration view showing an image forming section of a printer which is an example of an image forming apparatus in accordance with the present invention. FIG. 2 is a block diagram showing an electrical configuration of the printer.

As shown in FIGS. 1 and 2, a printer 1 includes a recording sheet feeding section 2, an image forming section 3, a fixing section 4, a communication section 5, and a controller 6. The recording sheet feeding section 2 has an unillustrated sheet-feeding cassette and feeds recording sheets, which are stacked in the sheet-feeding cassette, one after another from an uppermost position of the stack to the image forming section 3 by a rotating operation of an unillustrated sheet feeding roller which is urged against the recording sheets by an urging mechanism composed of a spring or the like.

The communication section 5 is adapted to execute communication processing of various data with respect to external equipment. For example, the communication processing includes receiving of image data which is sent from the external equipment such as a personal computer communicably connected to the printer 1.

As shown in FIG. 1, the image forming section 3 includes a photoconductive drum 7 rotatably supported on a shaft and having a photoconductivity, and a charging device 8, an exposure device 9, a developing section 10, an intermediate image transferring member 11, a cleaning section 12, and a charge removing device 13 are arranged in a periphery of and along a rotational direction of the photoconductive drum 7. The image forming section 3 performs an electrophotographic processing to form a predetermined toner image on the photoconductive drum 7 and transfers the toner image to the recording sheet.

The charging device 8 is adapted to charge the photoconductive drum 7 at a constant polarity (a positive polarity in the present embodiment).

The exposure device 9, though it is not illustrated in detail, includes a unit having a laser emitting device and a polygon mirror, and a reflective mirror. The exposure device 9 outputs from the laser emitting device a light having strength and weakness in accordance with document image data received by the communication section 5 and irradiates the light to exposed areas on the photoconductive drum 7 which is charged to a positive polarity through the polygon mirror and the reflective mirror, so that image dots are formed on the surface of the photoconductive drum 7. The irradiated light reduces the surface electrical potential of the photoconductive drum 7 in accordance with the image so as to form an electrostatic latent image associated with the document image data on the surface of the photoconductive drum 7. Rotation of the polygon mirror allows this light irradiation to repeatedly scan the exposed areas positioned between the charging device 8 and the developing section 10 in a width direction of the rotating photoconductive drum 7 (a direction perpendicular to a page of FIG. 1).

The developing section 10 includes a developing roller so arranged as to face the photoconductive drum 7, and an unillustrated toner container accommodating toners, and is adapted to supply toners, which have a polarity the same as that of a developing area, in other words, positively charged by application of a developing bias, to a part of the photoconductive drum 7 where a positive electric charge of the electrostatic latent image is reduced (electric potential is reduced) by the light. This renders toners to develop the electrostatic latent image formed on the photoconductive drum 7, so that a toner image as a visible image (developed image) is formed on the surface of the photoconductive drum 7. It should be understood that only the developing roller is illustrated in FIG. 1.

The intermediate image transferring member 11 includes, for example, a belt member having a part which runs in a tangential direction B of the surface of the photoconductive drum 7 in synchronization with rotation of the photoconductive drum 7 in direction A. The toner image formed by the developing section 10 on the surface of the photoconductive drum 7 is transferred to the intermediate image transferring member 11.

The cleaning section 12 includes an unillustrated cleaning blade which is so formed as to have a length which is substantially the same as a widthwise length of the photoconductive drum 7. The cleaning section 12 is so configured that it biases a leading end portion of the cleaning blade toward the surface of the photoconductive drum 7 by application of a biasing force of an unillustrated biasing member to scrape off remaining toners attached to the surface of the photoconductive drum 7 after the transfer operation.

The charge removing device 13, though it is not illustrated in detail, is so configured as to have a plurality of LED lamps arranged in array of at least one row along the width direction of the photoconductive drum 7. The charge removing device 13 renders the LED lamp to irradiate light to the surface of the photoconductive drum 7 to remove electric charge remaining on the photoconductive drum 7.

The image forming section 3 includes, in addition to the members 8 through 13, a surface electrical potential sensor 14 and a density sensor 15. The surface electrical potential sensor 14 is adapted to detect a surface electrical potential of the photoconductive drum 7. In the present embodiment, taking in consideration of cost and size, a configuration of indirectly detecting the surface electrical potential of the photoconductive drum 7 by detecting a charge current (DC current) in application of a charge bias to an unillustrated charging roller mounted in the charging device 8 is adopted.

The density sensor 15 is adapted to measure a toner density of the toner image which is formed on the surface of the photoconductive drum 7 by the developing processing of the developing section 10. The density sensor 15 of the present embodiment measures a toner density of the toner image transferred from the photoconductive drum 7 to the intermediate image transferring member 11, so that the toner density of the toner image formed on the surface of the photoconductive drum 7 is measured indirectly. However, the present invention is not limited to this configuration. A configuration of directly measuring a toner density of the toner image formed on the surface of the photoconductive drum 7 may be also adopted. The density sensor 15 has a configuration like the one shown in FIG. 3, for example.

Figure 3:
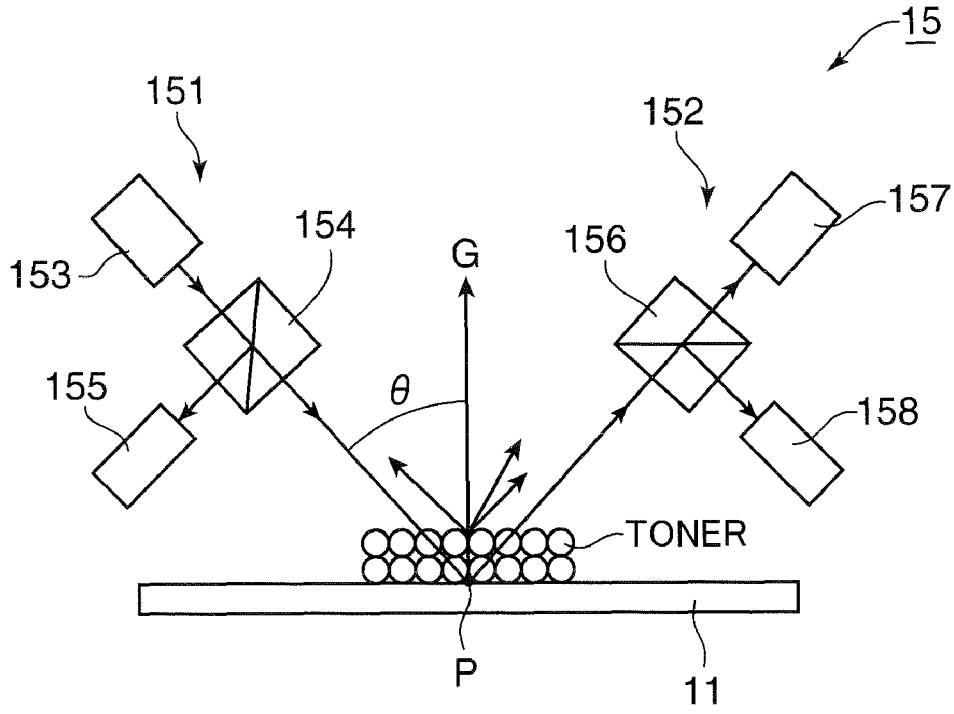
FIG. 3 shows a relationship between a toner density and a developing bias of a density patch which is formed on an intermediate image transferring member.

As shown in FIG. 3, the density sensor 15 has a configuration that first and second optical systems 151, 152 are arranged respectively on opposite sides of a normal line G passing through a fixed point P on a running path of the belt member constituting the intermediate image transferring member 11. The first optical system 151 has a light source 153 adapted to output a light toward the fixed point P on the surface of the belt member, a beam splitter 154 adapted to disperse the light outputted from the light source 153 into first and second polarization components, and a light receiver 155 adapted to receive one polarization component dispersed from the beam splitter 154. Each of the first and second polarization components includes a P-wave enabling a great output with respect to a black toner image to be obtained, and an S-wave enabling a great output with respect to color toner images of magenta toners, cyan toners and yellow toners to be obtained.

The light source 153 is so configured as to have, for example, an LED (Light Emitting Diode), and outputs a light including the equal quantities of the P-wave and the S-wave toward the fixed point P on the surface of the belt member at an incident angle θ with respect to the normal line G. The light receiver 155 is provided to control an output operation of the light source 153, and the controller 6, which will be described hereinafter, controls the outputted light of the light source 153 so that output signals of the light receiver 155 always remain constant.

The second optical system 152 is so configured as to have a beam splitter 156 adapted to disperse light reflected from the surface of the belt member into first and second polarization components, a first light receiver 157 adapted to receive a light of the first polarization component from among the first and second polarization components dispersed by the beam splitter 156, and a second light receiver 158 adapted to receive a light of the second polarization component from among the first and second polarization components.

The light reflected from the surface of the belt member includes a specular light in which the angle with respect to the normal line G is substantially the same as the incident angle θ and a diffused light other than the specular light. The ratio of the diffused light component increases in accordance with the amount of toners attached to the surface of the belt member, so that respective ratios of the first and second polarization components received by the first and second light receivers 157, 158 change. The density sensor 15 is configured based on this principle.

In other words, the density sensor 15 outputs the analog voltage associated with the respective ratios of the first and second polarization components received by the first and second light receivers 157, 158. When toners do not exist on the surface of the belt member, the first polarization component received by the first light receiver 157 becomes maximum, so that the output voltage becomes the maximum value. Increase in the amount of toners on the surface of the belt member reduces the light quantity of the first polarization component, so that the output voltage lowers. The controller 6, which will be described hereinafter, estimates the amount of toners attached to the surface of the belt member in accordance with output signals of the density sensor 15.

Now referring back to FIG. 2, the fixing section 4 performs a fixing processing of fixing toners onto a recording sheet by applying pressure and heat to the recording sheet onto which the toner image is transferred. Though it is not illustrated in detail, the fixing section 4 is provided with a heat-shielding box and a heater, and includes a fixing roller provided at an upper portion in the heat-shielding box and a pressing roller which is arranged in press-contact with the fixing roller at a lower portion in the heat-shielding box.

The controller 6 includes in an unillustrated CPU (Central Processing Unit: central arithmetic processing section) a peripheral device such as a storage portion including a RAM (Random Access Memory) and a ROM (Read Only Memory) for storing a program for defining an operation of the CPU and a RAM for temporarily storing data. This enables the controller 6 to execute an overall control over the printer 1 in accordance with instruction information received by an unillustrated operating section and the like and detection signals transmitted from sensors provided at sections of the printer 1.

Meanwhile, in the printer 1 having such configuration, as long as sections constituting the printer 1 are maintained at a state substantially the same as that at a reference time (for example, a time of shipment from a factory), a relationship between a developing bias and a toner density of a toner image formed on the belt member is maintained at a state substantially the same as that at the reference time. Accordingly, when the developing operation is performed at a predetermined developing bias which is set so as to correspond to a desirable developing bias, a toner image having a desirable toner density is formed on the belt member of the intermediate image transferring member 11. However, when the state of the sections constituting the printer 1 changes from the state which is substantially the same as that at the reference time (for example, a time of shipment from a factory), the relationship between the developing bias and the toner density of the toner image formed on the belt member changes from that at the reference time. Accordingly, it causes a likelihood that the toner image having the desirable toner density cannot be obtained even if the predetermined developing bias is applied.

Therefore, the printer 1 of the present embodiment is so designed as to confirm, for example, during a waiting time (a period during which an output of a document image is not performed) whether or not a relationship between the developing bias and the toner density of the toner image formed on the belt member changes from that at the reference time. When it is detected that the relationship between the developing bias and the toner density of the toner image formed on the belt member changes, an adjustment of the developing bias, which will be described hereinafter, is performed as a density correction, so that a stable and favorable state of the image forming operation is maintained even if a temperature change and a temporal change in the characteristic of the photoconductive drum 7 occur. The confirmation of whether or not the relationship between the developing bias and the toner density of the toner image formed on the belt member (hereinafter, it is referred to as a developing bias adjustment necessity confirmation) is performed as described herebelow, for example.

Figure 4A:
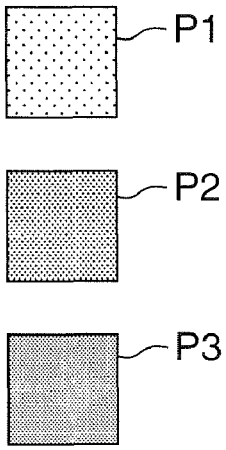
FIG. 4A shows an example of a density patch having a low print rate (for example, 25%).
Figure 4B:
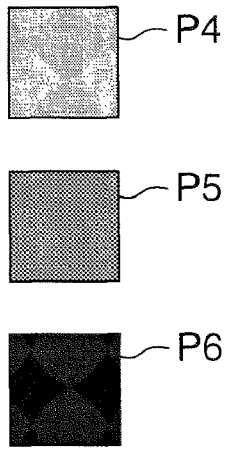
FIG. 4B shows an example of a density patch having a high print rate (for example, 100%).

The printer 1 stores developing bias adjusting image data, which is different from image data received from external equipment such as a computer, in the controller 6 (a patch storage portion 61, which will be described hereinafter). When performing the developing bias adjustment necessity confirmation, the printer 1 outputs the developing bias adjusting image data as density patches (corresponding to developing density adjustment patterns) to the surface of the belt member of the intermediate image transferring member 11. FIGS. 4A and 4B show an example of the density patches. FIG. 4A shows examples of a density patch having a low print rate (for example, 25%). FIG. 4B shows examples of a density patch having a high print rate (for example, 100%). The print rate corresponds to the number of dots per unit area for expressing the density of an image in the number of small dots. As shown in FIGS. 4A and 4B, toner densities of the density patches having a low print rate are relatively smaller than those of the densities patches having a high print rate.

As described above, the printer 1 stores image data showing density patches having different print rates in the controller 6 (patch storage portion 61, which will be described hereinafter). Here, density patches having two different print rates are shown. However, printer 1 may retain image data showing density patches having three or more print rates.

Further, in the present embodiment, a plurality of developing biases are set for each print rate. As shown in FIGS. 4A and 4B, the printer 1 is capable of forming density patches having different toner densities on the surface of the belt member at developing biases set for each print rate even if the print rate is the same.

In FIG. 4A, an example is shown where three developing biases V0, V1, V2 (V0<V1<V2) are set with respect to one image data (stored in the controller 6) indicating the density patches having a low print rate. In FIG. 4B, an example is shown where three developing biases V0, V1, V2 (V0<V1<V2) are set with respect to another one image data (stored in the controller 6) showing density patches of a high print rate.

In other words, the density patch P1 shown in FIG. 4A is formed when the printer 1 performs a density patch forming operation at the developing bias V0 with use of image data of the low print rate density patch. The density patch P2 shown in FIG. 4A is formed when the printer 1 performs the density patch forming operation at the developing bias V1 with use of image data of the low print rate density patch. The density patch P3 shown in FIG. 4A is formed when the printer 1 performs the density patch forming operation at the developing bias V2 with use of image data of the low print rate density patch. Further, the density patch P4 shown in FIG. 4B is formed when the printer 1 performs the density patch forming operation at the developing bias V0 with use of image data of the high print rate density patch. The density patch P5 shown in FIG. 4B is formed when the printer 1 performs the density patch forming operation at the developing bias V1 with use of image data of the high print rate density patch. The density patch P6 shown in FIG. 4B is formed when the printer 1 performs the density patch forming operation at the developing bias V2 with use of image data of the high print rate density patch. The developing biases V0, V1, V2 are, for example, 350(V), 400(V), 450(V), and the reason that a plurality of developing biases are set for each print rate will be described hereinafter.

In such printer 1 retaining the image data of density patches, at a time of performing a normal (when the surface electrical potential of the photoconductive drum 7 is greater than a predetermined threshold value) adjustment necessity confirmation of the developing bias, the low print rate density patch is adopted as a density patch to be formed on the belt member from among the high print rate density patch and the low print rate density patch to optimize the density of a half-tone image. The density of the density patch is measured by the density sensor 15, and the developing bias is adjusted in accordance with the measured density.

In particular, the printer 1 uses image data of the low print rate density patch stored in the controller 6 (patch storage portion 61) to apply the respective developing bias to the running belt member with time lags, and performs an operation of forming a plurality of density patches whose toner densities are different from one another. This allows the density patches P1 through P3 associated with the developing biases V0,V1,V2 to be formed on the surface of the belt member along the running direction of the belt member. When the density patches P1 through P3 are formed on the surface of the belt member, the density sensor 15 measures respective toner densities of the density patches P1 through P3.

Figure 5:
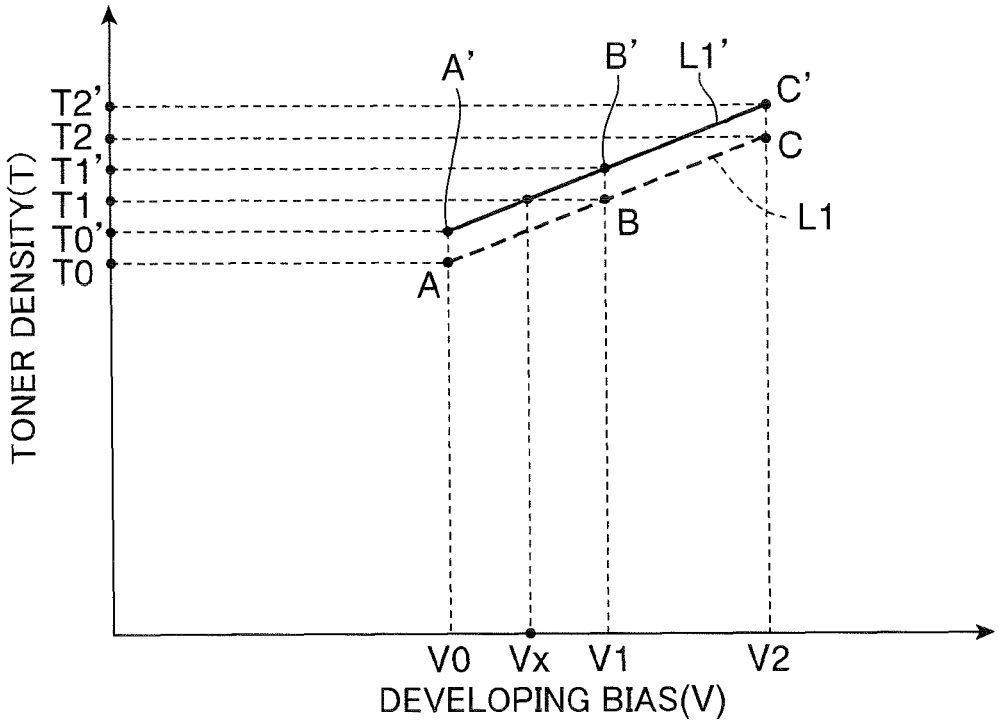
FIG. 5 shows a relationship between a developing bias and a toner density in a case where the density patch having a low print rate is selected.

FIG. 5 is a graph showing toner densities of a toner image, which can be obtained at respective developing biases at the reference time (for example a time of shipment from a factory) and the time of adjustment necessity confirmation of the developing bias. Here, it is assumed that, at the reference time, a density patch having a toner density T0 can be obtained by application of the developing bias V0, and a density patch having a toner density T1 can be obtained by application of the developing bias V1, and a density patch having a toner density T2 can be obtained by application of the developing bias V2. The points A, B, C shown in FIG. 5 are points indicating combinations of the developing biases V0, V1, V2 and the toner densities T0, T1, T2. As shown in FIG. 5, the toner density is proportional to the developing bias (the developing bias and the toner density have a linearity). Thus, all of these points A, B, C are on a straight line L1.

When state changes occur in sections of the printer 1, at least two of the toner densities of the toner images which can be obtained by application of the developing biases V0, V1, V2 deviate from the toner densities T0, T1, T2 (for example, comes into the state of A', B', C'). Accordingly, a developing bias at which the target value T1 can be obtained changes (developing bias Vx) from the developing bias V1 at which the target value T1 can be obtained if the state changes do not occur in sections of the printer 1.

However, when the surface electrical potential of the photoconductive drum 7 does not lower from that at the reference time, it is often likely that the points A', B', C' are on the straight line L1' to maintain the linearity of the developing bias and the toner density even if the state of the sections of the printer 1 changes from the state substantially the same as that at the reference time (for example a time of shipment from a factory).

The printer 1 utilizes the linearity to calculate the developing bias Vx for obtaining the target value T1. In other words, since the developing bias and the toner density are in the proportional relationship even after the toner density changes, the following Equation (1) using the developing bias V0 and the toner density T0' at the point A' and the developing bias V1 and the toner density T1' at the point B' can be established.

$$(T1-T0')/(Vx-V0)=(T1'-T1)/(V1-Vx) \quad (1)$$

The printer 1 uses the Eq. (1) to calculate the toner density Vx. The reason that a plurality of developing biases are set for each print rate is because a plurality of combinations of the developing bias and the toner density can be obtained for execution of the calculation utilizing the linearity (the calculation with use of the Equation (1)).

Figure 6:
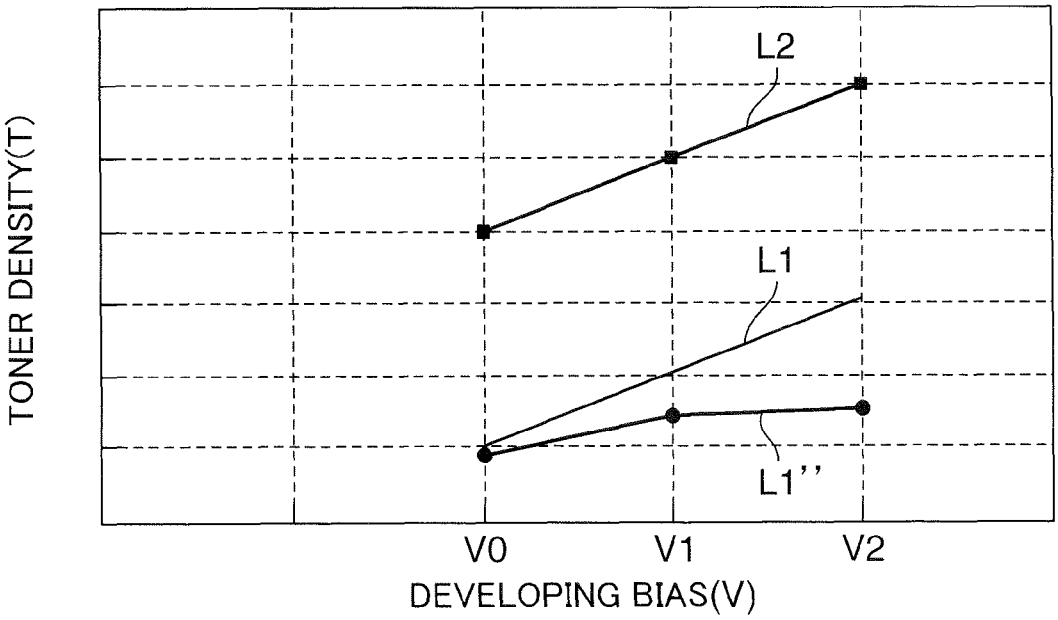
FIG. 6 illustrates a phenomenon which occurs at a time when a surface electrical potential of a photoconductive member lowers.

However, when the surface electrical potential of the photoconductive drum 7 becomes lower than that at the reference time, the density patch having toner densities increasing in proportion to the developing bias cannot be obtained as indicated by the graph L1" of FIG. 6 for example, so that the linearity of the developing bias and the toner density is lost. As a result, the linearity cannot be utilized to set the developing bias for obtaining the desirable toner density (for example, the Equation (1)), so that an appropriate adjustment of the developing bias and an accurate density adjustment cannot be performed.

On the other hand, in a case where the high print rate density patch is used at a time of performing the developing bias adjustment necessity confirmation and the developing bias adjustment unlike the above-described case where the low print rate density patch is used, the linearity between the developing bias and the toner density is substantially maintained even if the temperature change and the temporal change in the characteristic of the photoconductive drum 7 occur.

Figure 7:
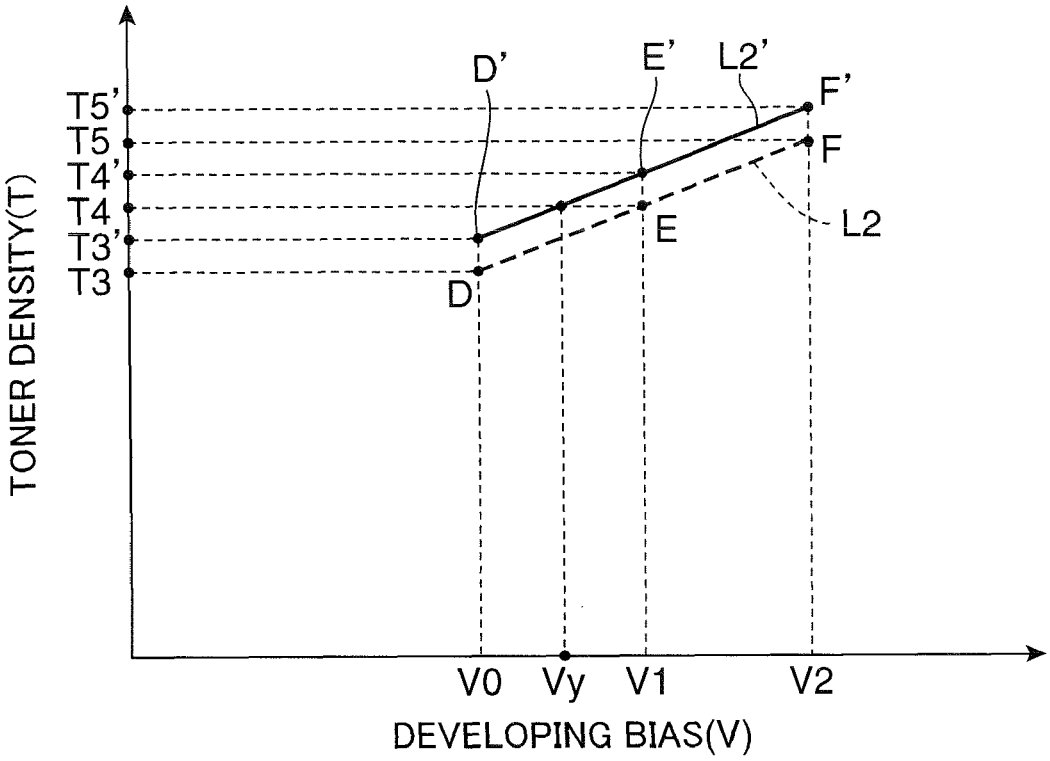
FIG. 7 shows a relationship between a developing bias and a toner density in a case where the density patch having a low print rate is selected.

In other words, the straight line L2 of FIG. 6 is a straight line passing through points indicating combinations of the developing biases and the toner densities at the reference time in a case where the high print rate density patch is used for the developing bias adjustment necessity confirmation and the developing bias adjustment. Even if the surface electrical potential of the photoconductive drum 7 becomes lower than that at the reference time, the relationship between the developing biases and the toner densities have a relationship indicated by, for example, the straight line L2' as shown in FIG. 7 when the high print rate density patch is used for the developing bias adjustment necessity confirmation and the developing bias adjustment. Accordingly, although the relationship is not matching with the relationship indicated by the straight line L2, the linearity is maintained.

Therefore, in the present embodiment, when the surface electrical potential of the photoconductive drum 7 is within a predetermined normal range, the low print rate density patch is used to execute the developing bias adjustment necessity confirmation and the developing bias adjustment. However, when the surface electrical potential is not within the normal range, the high print rate density patch is used to execute the developing bias adjustment necessity confirmation and the developing bias adjustment.

To realize such configuration, the controller 6 includes the patch storage portion 61, a surface electrical potential determining portion 62, a patch selecting portion 63, and a density adjusting portion 64, functionally.

The patch storage portion 61 is adapted to store image density of a plurality of kinds of patches, like the density patches P1 through P6 of FIGS. 4A and 4B for example, for use in the developing bias adjustment necessity confirmation and the developing bias adjustment. In the following descriptions, for simplification of the descriptions, the patch storage portion 61 stores image data of two kinds of density patches including image data of the low print rate density patch and image data of the high print rate density patch.

The surface electrical potential determining portion 62 is adapted to determine a magnitude relation between the surface electrical potential indicated by detection signals of the surface electrical potential sensor 14 and a predetermined threshold value.

The patch selecting portion 63 selects the low print rate density patch from among the density patches stored in the patch storage portion 61 when the surface electrical potential determining portion 62 determines that the surface electrical potential indicated by the detection signals of the surface electrical potential sensor 14 is greater than the predetermined threshold value (when the surface electrical potential of the photoconductive drum 7 is within the predetermined normal range). On the other hand, the patch selecting portion 63 selects the high print rate density patch when it is determined that the surface electrical potential indicated by the detection signals of the surface electrical potential sensor 14 is smaller than the predetermined threshold value (when the surface electrical potential of the photoconductive drum 7 is not within the predetermined normal range).

The density adjusting portion 64 is adapted to use a patch selected by the patch selecting portion 63 to perform a density adjustment in accordance with a density value indicated by an output signal of the density sensor 15. In other words, in a case where the patch selecting portion 63 selects the low print rate density patch, and the density adjusting portion 64 determines that the straight line indicating the relationship between the developing biases and the toner densities changes from the straight line L1 to the straight line L1', for example, as shown in FIG. 5, so that the developing bias adjustment is required, the density adjusting portion 64 uses the developing biases V0, V1, V2 and the toner densities T0', T1', T2' associated with the points A', B', C' on the straight line L1', and the Equation (1) to calculate the developing bias Vx at which the target value T1 of the toner density can be obtained.

On the other hand, in a case where the patch selecting portion 63 selects the high print rate density patch, and the density adjusting portion 64 determines that the straight line indicating the relationship between the developing biases and the toner densities from the straight line L2 to the straight line L2', for example, as shown in FIG. 7, so that the developing bias adjustment is required, the density adjusting portion 64 uses the developing biases V0, V1, V2 and the toner densities T3', T4', T5' associated with the points D', E', F' on the straight line L2', and an Equation substantially the same as the Equation (1) to calculate the a developing bias Vy at which a target value T4 of the toner density. The target value T4 is a value which is determined in accordance with the ratio of the print rate of the low print rate density patch and the print rate of the high print rate density patch, and the target value T1 of the toner density used in a case of adopting the low print rate density patch.

Figure 8:
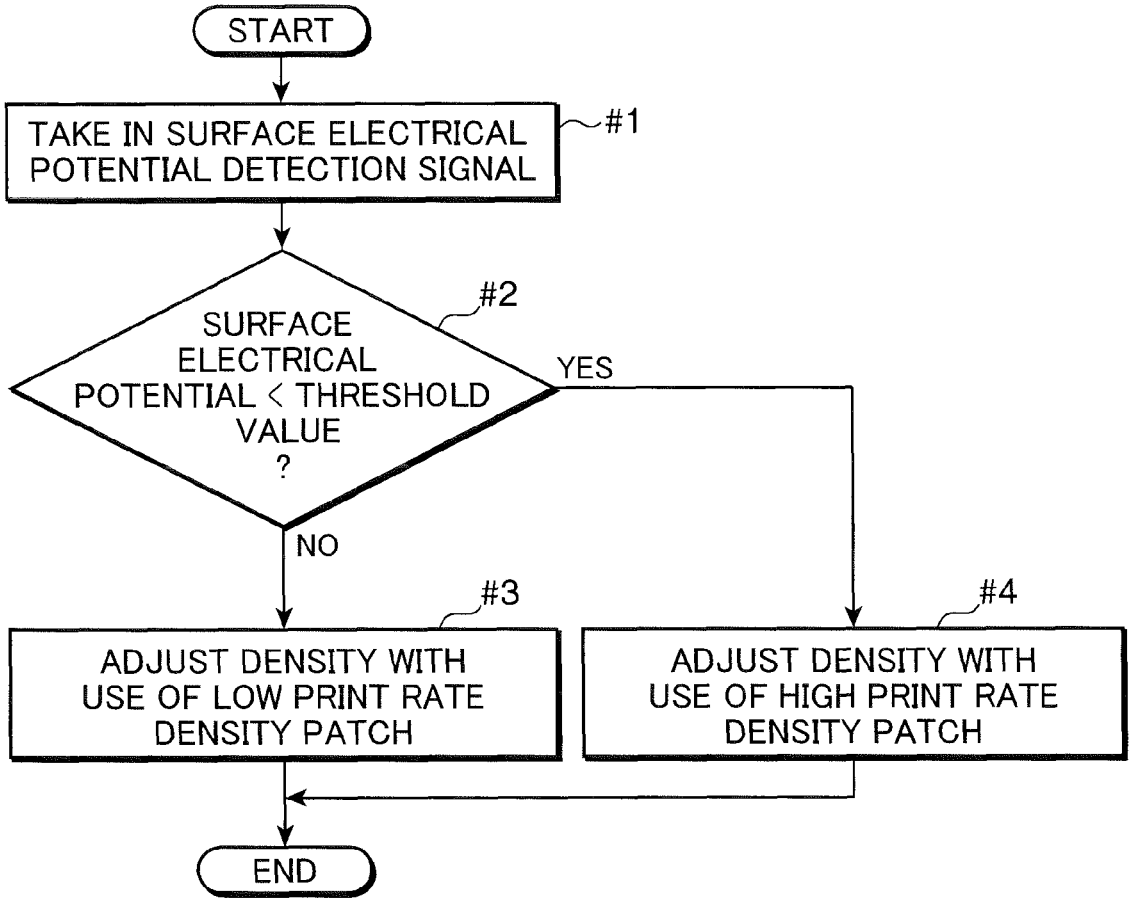
FIG. 8 is a flowchart showing a density adjustment processing of a controller.

FIG. 8 is a flowchart showing the density adjustment process of the controller 6.

As shown in FIG. 8, the controller 6 takes in a detection signal indicating the surface electrical potential of the photoconductive drum 7 from the surface electrical potential sensor 14 (step #1) and determines whether or not the surface electrical potential is smaller than the predetermined threshold value (step #2). As a result, when the controller 6 determines that the surface electrical potential is equal to or greater than the predetermined threshold value (NO in step #2), it uses the low print rate density patch to execute the density adjustments (the developing bias adjustment necessity confirmation and the developing bias adjustment) (step #3). When the controller 6 determines that the surface electrical potential is smaller than the predetermined threshold value (NO in step #1), it uses the high print rate density patch to execute the density adjustment (step #4).

As described above, a configuration is adopted in which the density patch used in execution of the density adjustment is switched from the normally used low print rate density patch to the high density patch, and the density adjustment is executed with use of the switched density patch at a time when the surface electrical potential of the photoconductive drum 7 becomes lower than the predetermined threshold value. Accordingly, an optimal density adjustment can be set while drastically reducing increase of a correction processing time relative to the case of executing the correction processing with use of a conventional γ conversion processing.

In the above-described embodiment, a configuration of detecting a charge current (DC current) the same as that at a time of applying a charge bias to an unillustrated charge roller mounted in the charging device 8 to indirectly detect the surface electrical potential of the photoconductive drum 7. The present invention is not limited to this configuration. A configuration of including a rotation time measuring portion 65 (refer to FIG. 2), which is adapted to measure a rotation time of the photoconductive drum 7, to indirectly detect the surface electrical potential of the photoconductive drum 7 with use of the rotation time measured by the rotation time measuring portion 65. In other words, it may be so configured that when the rotation time measured by the rotation time measuring portion 65 reaches a predetermined time, the patch selecting portion 63 determines that the surface electrical potential of the photoconductive drum 7 reaches the threshold value used in determination by the surface electrical potential determining portion 62 and switches the density patch for use in the density adjustment from the low print rate density patch to the high print rate density patch.

Further, in the above-described embodiment, two kinds of density patches including the low print rate density patch and the high print rate density patch are prepared, and a threshold value for comparing the detected detection surface electrical potential of the photoconductive drum 7 is provided, so that density patches which are to be adopted are switched between the density patches having two kinds of print rates in accordance with magnitudes of the surface electrical potential of the photoconductive drum 7 and the threshold value. However, three or more kinds of print rates of the density patch and a plurality of threshold values to be compared with the detected surface electrical potential of the photoconductive drum 7 may be provided. Accordingly, a print rate of the density patch to be adopted may be selected from among a plurality of print rates of the density patch in accordance with magnitudes of the surface electrical potential of the photoconductive drum 7 and the threshold values, so that the density adjustment may be executed with use of the density patch of the print rate.

Further, in the above-described embodiment, the developing bias adjustment necessity confirmation is executed. However, not limited to this, the calculation may be executed with use of the Equation (1) without execution of the developing bias adjustment necessity confirmation.

Further, a plurality of pairs of the photoconductive drum 7 and the developing section 10 shown in FIG. 1 may be provided. In an image forming apparatus which is so configured that each pair forms a toner image of a color different from another onto the intermediate image transferring member 11, it may have a configuration in which image data of density patches having a plurality of kinds of print rates may be provided for each color, so that the density adjustment process shown in FIG. 8 is executed for each color.

The image forming apparatus in accordance with the present invention described above with reference to the drawings comprises: a developing section for developing an electrostatic latent image formed on an image bearing member with use of developer applied with a developing bias; a density detecting portion for detecting directly or indirectly a density of a developed image formed on the image bearing member; a surface electrical potential detecting portion for detecting directly or indirectly a surface electrical potential of the image bearing member; a developing bias correcting portion for developing a predetermined developing density adjustment pattern on the image bearing member and correcting the developing bias in accordance with the density of the developing density adjustment pattern detected by the density detecting portion; a developing density adjustment pattern storage portion for storing a plurality of developing density adjustment patterns having print rates different from one another. The developing bias correcting portion changes a developing density adjustment pattern, which is to be developed on the image bearing member, in accordance with a surface electrical potential detected by the surface electrical potential detecting portion.

According to the above-described image forming apparatus, the developing density adjustment pattern which is to be developed on the image bearing member is changed in accordance with the surface electrical potential detected directly or indirectly by the surface electrical potential detecting portion. Accordingly, as compared to the case of executing a correction processing with use of a γ conversion processing like the conventional technologies, increase in a correction processing time can be suppressed drastically than that of the conventional technologies.

In the above-described image forming apparatus, it is preferable that when the surface electrical potential detected by the surface electrical potential detecting portion is smaller than a predetermined threshold value, the developing bias correcting portion changes the developing density adjustment pattern which is to be developed on the image bearing member to a developing density adjustment pattern having a print rate which is higher than that used in a case where the surface electrical potential is higher than the threshold value.

When the developing density adjustment pattern having a high print rate is developed on the image bearing member, and a density of the developing density adjustment pattern is detected on the image bearing member by the density detecting portion, the linearity between the developing bias and the toner density is secured even if an environmental change occurs.

Therefore, when the surface electrical potential detected by the surface electrical potential detecting portion in such a manner as described above is smaller than a predetermined threshold value, changing the developing density adjustment pattern which is to be developed on the image bearing member to a developing density adjustment pattern having a high print rate which is higher than that used in a case where the surface electrical potential is greater than the threshold value, and adopting a developing density adjustment pattern having a high print rate in which the linearity between the developing biases and the toner densities is secured as a developing density adjustment pattern which is to be utilized in a density adjustment allows an optimal density adjustment to be executed.

Further, in the image forming apparatus, it is also possible that the surface electrical potential detecting portion includes a driving time measuring portion which measures a driving time of the image bearing member, and when the driving time measured by the driving time measuring portion reaches a predetermined time, the developing bias correcting portion changes the developing density adjustment pattern which is to be developed on the image bearing member.

Adopting the above-described characteristic enables to establish a configuration of measuring a driving time of the image bearing member and indirectly detecting the surface electrical potential of the image bearing member in accordance with the measured time. Accordingly, the configuration of detecting the surface electrical potential of the image bearing member may be simplified.

This application is based on Japanese Patent Application Serial No. 2006-355259, filed in Japanese Patent Office on Dec. 28, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a developing section for developing an electrostatic latent image formed on an image bearing member with use of developer applied with a developing bias;

a density detecting portion for detecting directly or indirectly a density of a developed image formed on the image bearing member;

a surface electrical potential detecting portion for detecting directly or indirectly a surface electrical potential of the image bearing member;

a developing bias correcting portion for developing a predetermined developing density adjustment pattern on the image bearing member and correcting the developing bias in accordance with the density of the developing density adjustment pattern detected by the density detecting portion;

a developing density adjustment pattern storage portion for storing a plurality of developing density adjustment patterns having print rates different from one another, wherein the developing bias correcting portion changes a developing density adjustment pattern, which is to be developed on the image bearing member, in accordance with a surface electrical potential detected by the surface electrical potential detecting portion.

2. The image forming apparatus according to claim 1, wherein when the surface electrical potential detected by the surface electrical potential detecting portion is smaller than a predetermined threshold value, the developing bias correcting portion changes the developing density adjustment pattern which is to be developed on the image bearing member to a developing density adjustment pattern having a print rate which is higher than that used in a case where the surface electrical potential is higher than the threshold value.

3. The image forming apparatus according to claim 2, wherein the surface electrical potential detecting portion includes a driving time measuring portion which measures a driving time of the image bearing member, and wherein when the driving time measured by the driving time measuring portion reaches a predetermined time, the developing bias correcting portion changes the developing density adjustment pattern which is to be developed on the image bearing member.

4. The image forming apparatus according to claim 1, wherein the surface electrical potential detecting portion includes a driving time measuring portion which measures a driving time of the image bearing member, and wherein when the driving time measured by the driving time measuring portion reaches a predetermined time, the developing bias correcting portion changes the developing density adjustment pattern which is to be developed on the image bearing member.

5. A developed image density correcting method for correcting a density of an image developed on an image bearing member of an image forming apparatus which includes a developing section for developing an electrostatic latent image formed on an image bearing member with use of developer applied with a developing bias, a density detecting portion for detecting directly or indirectly a density of a developed image formed on the image bearing member, a surface electrical potential detecting portion for detecting directly or indirectly a surface electrical potential of the image bearing member, and a developing bias correcting portion for developing a predetermined developing density adjustment pattern on the image bearing member and correcting the developing bias in accordance with the density of the developing density adjustment pattern detected by the density detecting portion, the method comprising the steps of:

(a) developing a prepared developing density adjustment pattern on the image bearing member;

(b) correcting the developing bias in accordance with a density of the developing density adjustment pattern detected by the density detecting portion, wherein said step (b) includes a sub-step of changing the developing density adjustment pattern, which is to be developed on the image bearing member, in accordance with the surface electrical potential detected by the surface electrical potential detecting portion.

6. The developed image density correcting method according to claim 5, wherein in said step (b), when the surface electrical potential detected by the surface electrical potential detecting portion is smaller than a predetermined threshold value, the developing density adjustment pattern which is to be developed on the image bearing member is changed to a developing density adjustment pattern having a print rate which is higher than that used in a case where the surface electrical potential is higher than the threshold value.

7. The developed image density correcting method according to claim 6, wherein the surface electrical potential detecting portion includes a driving time measuring portion which measures a driving time of the image bearing member, and wherein in said step (b), when the driving time measured by the driving time measuring portion reaches a predetermined time, the developing density adjustment pattern which is to be developed on the image bearing member is changed.

8. The developed image density correcting method according to claim 5, wherein the surface electrical potential detecting portion includes a driving time measuring portion which measures a driving time of the image bearing member, and wherein in said step (b), when the driving time measured by the driving time measuring portion reaches a predetermined time, the developing density adjustment pattern which is to be developed on the image bearing member is changed.

* * * * *